US005820499A

United States Patent [19]

Thomas et al.

[11] Patent Number: 5,820,499

[45] Date of Patent: Oct. 13, 1998

[54] MAGAZINE BALL DISPENSER

[76] Inventors: Keith Thomas, 4835 High Way 52, Loretto, Ky. 40037; Dan Thompson, 335 Raywick Rd., St. Francis, Ky. 40062

[21] Appl. No.: 638,132

[22] Filed: Apr. 26, 1996

[51] Int. Cl.[6] ..... A63B 39/00

[52] U.S. Cl. ..... 473/496; 221/220; 211/14

[58] Field of Search ..... 473/496, 113; 211/13.1, 14; 221/220

[56] References Cited

U.S. PATENT DOCUMENTS

| | | | |
|---|---|---|---|
| 2,569,007 | 9/1951 | Klyce | 473/496 |
| 3,853,316 | 12/1974 | Smith | 473/496 |
| 5,368,172 | 11/1994 | Barringer | 211/13 |
| 5,472,189 | 12/1995 | Pfeiffer et al. | 473/496 |

FOREIGN PATENT DOCUMENTS

| | | | |
|---|---|---|---|
| 2219177 | 10/1973 | Germany | 473/113 |
| 10643 | 4/1903 | United Kingdom | 473/113 |
| 857260 | 12/1960 | United Kingdom | 473/113 |

*Primary Examiner*—Mark S. Graham
*Attorney, Agent, or Firm*—Charles M. Hogan

[57] ABSTRACT

A tubular table tennis ball storage and discharge magazine formed with a lateral discharge opening and positioned gravitationally to feed the balls to the opening, the magazine having elastic retainers at the opening to hold the advance ball poised for selection.

2 Claims, 1 Drawing Sheet

MAGAZINE BALL DISPENSER

BACKGROUND OF THE INVENTION

This invention is a novel tubular ball containing magazine dispenser with a ball feeding aperture for dispensing of table tennis balls in rapid fashion incorporated into a table tennis table leg or suspended from structure thereof.

Throughout the history of table tennis, various ball dispensers have been available Most are geared toward storage of accessories, including spare balls, at the end of the game.

One example is U.S. Pat. No. 3,064,823 issued Nov. 20,1962 Table Tennis Set Mounting and Retaining Means by Frank Shock of Wichita, Kans. designed for periods of nonuse. This design is limited concerning ease of use where rapid dispensing of spare balls is desired when practicing or during a heated table tennis match. No means is suggested for gravitational dispensing of spare balls or lateral ball discharge. Additionally its size and general construction prohibit positioning possibilities required where rapid access of balls is desired .This design is not practical for practice or play.

In U.S. Pat. No. 3,842,979 Table Tennis Paddle and Ball Rack by Harold Doelcher of Granada Hills, Calif. issued Oct. 22, 1974 downward removal of spare balls is not possible thereby limiting this design where gravitational dispense of spare balls is desired. This limits ease of use and prohibits immediate access of spare balls desired at ones' fingertips when practicing or during a heated table tennis match.

Other dispensers offer access to spare balls but are limited where rapid access of balls is desired. In U.S. Pat. No. 3,853,316 by Max Smith of Evansville, Ind. issued Dec. 10, 1974—Table Tennis Ball Holder, spare balls are not quickly accessible by grasping with direct contact Balls must first be forced from the holding tube requiring much time and manipulation, interrupting practice or the game. No means of gravitational dispense or ball discharge aperture is suggested or implied by the prior art.

Currently available products fail to offer a ball dispenser which allows easy continuous access to spare ball(s) for dispensing in rapid fashion. Such a dispenser should provide easy, continuous, immediate access to spare balls allowing uninterrupted play and may provide convenient storage of spare ball(s).

BRIEF DESCRIPTION OF THE DRAWING FIGURES

SUMMARY OF THE INVENTION

This invention conceives a table tennis ball dispenser which provides continuous and immediate access to spare balls for dispensing in rapid fashion. Furthermore, the invention may provide convenient storage of spare balls.

It is therefore an object of this invention to provide a table tennis ball dispenser which provides easy, continuous and immediate access to spare balls for dispensing in rapid fashion.

Another object of this invention is to provide a ball containing accessory which gravitationally suspends, holds and dispenses a sequence of balls to a discharge aperture.

Another object of this invention is to provide a table tennis ball dispenser which allows downward removal of spare balls.

Another object of this invention is to provide a table tennis ball dispenser which allows removal of spare balls by of direct contact upon the ball.

Another object of this invention is to provide a table tennis ball dispenser formed by tubular ball containing magazines incorporated into tennis table legs or suspended from structure thereof.

These objects become apparent from the preceding and following disclosures.

DESCRIPTION OF THE PREFERRED EMBODIMENTS

Figure 1:
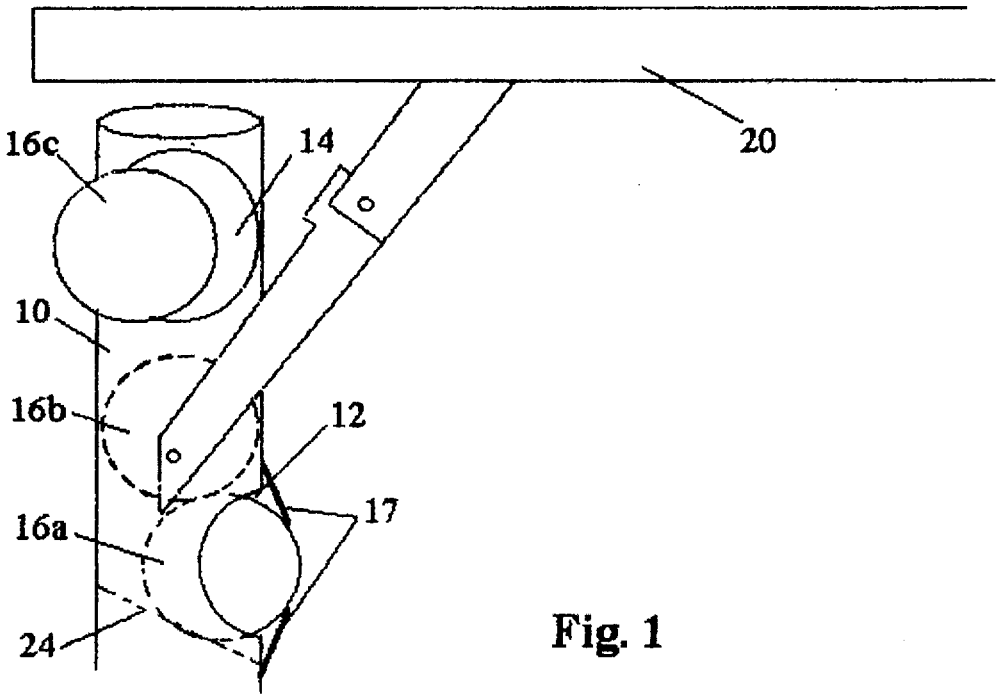
FIG. 1 shows a frontal perspective view of a tubular ball containing magazine dispenser with ball feeding aperture and loading port incorporated into leg of table tennis table.

Referring now to the drawings there is shown in FIG. 1 a preferred embodiment of the invention. A table tennis table 20 having a playing surface and an under surface is provided with four support legs one being shown in the drawings. In accordance with the invention the leg is dual purpose in that it not only provides table support but is creatively formed as an accessory for the reception storage and sequential release of table tennis ball(s). Another concept of the invention is adaptation of such an accessory to itself as a support for the table.

Leg 10 is bored or made hollow or tubular in form to provide a longitudinal magazine for gravitationally suspending holding and dispensing a sequence of balls to a lateral ball dispenser comprising a lateral port 12 and elastic retaining tabs 17, positioned adjacent port 12, suspending yieldably to retain the loose ball 16A and maintain a sequence of ball(s) 16A, 16B and 16C.

Leg 10 is suspended have to or otherwise fastened vertically to table 20 so that when the table is set up ball(s) fall from receiving aperture 14 under the influence of gravity to the stop 24 of dispenser port 12. The loose ball 16A projects, through the dispenser port 12, retained by tabs 17, which respond to the ball's-invitational grasp of the operator.

Figure 2:
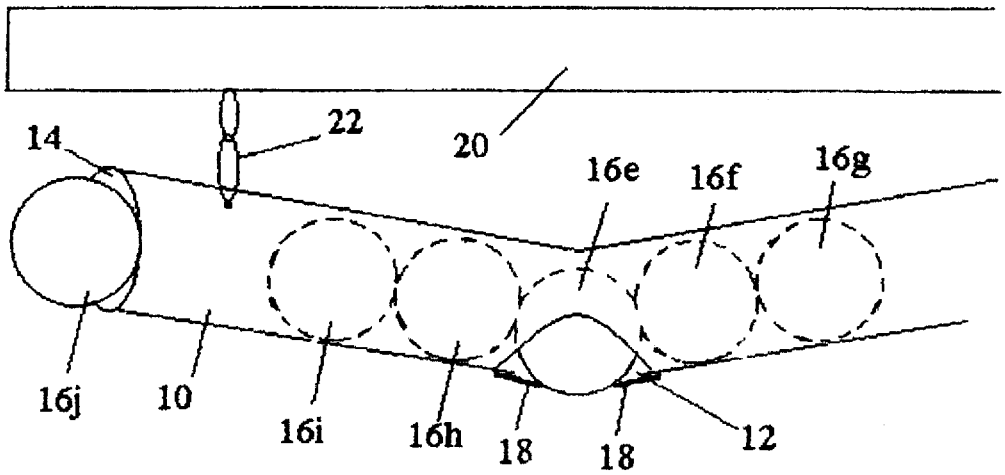
FIG. 2 shows a perspective view of a tubular ball containing magazine formed into a V-shape with ball feeding aperture at the apex suspended from the underside of a table tennis playing surface.

FIG. 2 shows another embodiment of the invention in which the accessory is formed with a symmetrical body 10; tubular or having a bore, shaped with a V shape apex. The body is so suspended by links 22 or the like thus, the apex extends downward to permit the ball(s) 16E, 16F, 16G, 161, and 16I to flow from opening 14 gravitationally toward dispensing port 12 opening laterally or transversely at the apex. Ball 16J likewise strides toward the apex. Ball 16E is grasped by operator as tabs 18 yield. Ball(s) 16F and 16H do not seriously jamb as they approach port 12 because the player can manually nudge on one or the other diagonally upwards in the magazine Only a portion of FIG. 2 structure is shown because its structure is symmetrical with ball receiving or loading aperture at each end.

We claim:

1. A table tennis ball dispenser for use as an accessory with a table tennis table, said dispenser providing for storage and release of individual table tennis balls as selected by a player, said dispenser comprising in combination:

a rigid, tubular member formed longitudinally in the shape of a V converging toward an apex, and having terminal ball receiving openings, a central ball delivery aperture at said apex, and a bore for storing table tennis balls;

a pair of diametrically opposed elastic tabs projecting into said aperture to arrest a ball; and a pair of spaced links for suspending said tubular member alongside a table edge so that apex points downwardly, whereby balls deposited in said openings are gravitationally displaced toward said aperture, said tabs yielding to the grasp of a player to release a ball arrested in said aperture.

2. A table tennis ball dispenser for use as an accessory with a table tennis table, said dispenser providing for storage and release of individual table tennis balls as selected by a player, said dispenser comprising in combination:

a rigid, tubular member formed longitudinally in the shape of a V converging toward an apex, and having terminal ball receiving openings, a central ball delivery aperture at said apex, and a bore for storing table tennis balls;

elastic means projecting into said aperture to arrest a ball; and means adapted to suspend said tubular member alongside a table edge so that apex points downwardly, whereby balls deposited in said openings are gravitationally displaced toward said aperture, said elastic means yielding to the grasp of a player to release a ball arrested in said aperture.

* * * * *